United States Patent [19]

Kurisu et al.

[11] Patent Number: 5,033,422

[45] Date of Patent: Jul. 23, 1991

[54] VALVE DRIVE APPARATUS FOR DOUBLE OVERHEAD CAMSHAFT ENGINE

[75] Inventors: Toru Kurisu; Akira Kurihara; Yasuo Yukitake, all of Hiroshima, Japan

[73] Assignee: Mazda Motor Corporation, Hiroshima, Japan

[21] Appl. No.: 545,951

[22] Filed: Jul. 2, 1990

[30] Foreign Application Priority Data

Jun. 30, 1989 [JP] Japan ..... 1-170618

[51] Int. Cl.[5] ..... F01L 1/26

[52] U.S. Cl. ..... 123/90.27; 123/193 H

[58] Field of Search ..... 123/90.27, 90.39, 193 H

[56] References Cited

U.S. PATENT DOCUMENTS 4,617,881 10/1986 Aoi et al. ..... 123/90.22
4,624,222 11/1986 Yoshikawa ..... 123/90.23
4,957,079 9/1990 Nakatani et al. ..... 123/90.27

FOREIGN PATENT DOCUMENTS 0093407 4/1987 Japan ..... 123/90.27
0267308 10/1989 Japan ..... 123/90.27

*Primary Examiner*—David A. Okonsky
*Assistant Examiner*—Weilun Lo
*Attorney, Agent, or Firm*—Fleit, Jacobson, Cohn, Price, Holman & Stern

[57] ABSTRACT

A valve drive apparatus comprises a pair of valve trains, each having a rocker arm and a hydraulic lash adjuster, arranged symmetrically with respect to a center axis of each cylinder of a double overhead camshaft engine. Either one of the pair of valve trains that has a rocker arm leverage greater than a rocker arm leverage of the other of the pair of valve trains is adapted and designed so as to have a structural rigidity higher than the structural rigidity of the other.

9 Claims, 2 Drawing Sheets

VALVE DRIVE APPARATUS FOR DOUBLE OVERHEAD CAMSHAFT ENGINE

FIELD OF THE INVENTION

The present invention relates to a valve drive apparatus for a double overhead camshaft engine, and more particularly, to a valve drive apparatus of the type having a rocker arm which allows the double overhead camshaft engine to operate at a high speed without causing abnormal vibrations of a valve train, such as jumping or bouncing.

BACKGROUND OF THE INVENTION

A typical type of valve drive apparatus used for a double overhead camshaft engine has a pair of valve trains for one cylinder of the engine. The pair of valve trains, having the same structural elements, are symmetrically arranged in a V-formation with a predetermined relative angle with respect to a center axis of the cylinder. Although camshafts for timely, or sequentially, opening and closing valves through the valve trains are driven mechanically or geometrically in the same direction, they are driven dynamically in the opposite directions with respect to rocker arms. That is, because the geometric relative arrangement of the rocker arm with respect to the direction of rotation of the camshaft is opposite between the pair of valve trains and because leverage of the rocker arm changes with the rotation of camlobe, characteristic curves representing the changes of leverage of the rocker arms are symmetrical with respect to rotated angles of the camlobe. Accordingly, at a moment immediately before the valve closes, the leverage of either one of the rocker arms is larger than that of the other.

As is well known in the art, unusual vibration of the valve train is one of the primary factors that adversely affects an engine and tends to prevent satisfactory operation at high speeds. That is, when a harmonic component, having a low frequency, of a valve lift curve of a valve becomes close to a natural frequency of the valve train as engine speed increases, the natural frequency of the valve train becomes too high, so that the valve train causes unusual vibration, such as jumping or bounding. In order to raise a critical engine speed at which the engine causes unusual vibration, it si absolutely necessary to increase the natural frequency of the valve train. Both an equivalent rigidity of valve train, which depends greatly on the leverage of rocker arm, and an equivalent mass of the valve are the primary factors in determining the natural frequency of the valve train. Since the equivalent rigidity of valve train becomes higher as the leverage of the rocker arm becomes smaller, the use of a small leverage rocker arm is favorable and preferred in order to allow the engine to increase the critical engine speed in a satisfactory manner. Additional details may be obtained by reference to a book entitled, "Automobile Engineering Handbook: IV," pages 1–52, published by Automobile Technology Association.

SUMMARY OF THE INVENTION

It is, therefore, a primary object of the present invention to provide a valve drive apparatus for a double overhead camshaft engine which has an improved structure of a valve train so as to enable the engine to operate at a high critical speed.

A valve drive apparatus in accordance with the present invention comprises a pair of valve trains disposed between a pair of valves, having axes of movement arranged symmetrically at a predetermined relative angle with respect to a center axis of cylinder, for each cylinder of the engine and a pair of overhead camshafts with camlobes, arranged in juxtaposition and rotating in the same direction, so as to timely drive the pair of valves. The pair of valve trains, each having a rocker arm and a hydraulic lash adjuster, are arranged geometrically symmetrically with respect to the center axis of the cylinder. Either one of the pair of valve trains having a rocker arm leverage greater than rocker arm leverages of the other valve trains at the beginning of closing a valve is designed so as to have a structural rigidity higher than the structural rigidity of the other.

To provide either one of the pair of valve trains, which has a rocker arm leverage greater than rocker arm leverages of the other valve trains at the beginning of closing a valve, with a structural rigidity which is higher than the other, the valve train is provided with a lash adjuster having a cross-section greater than that of a lash adjuster of the other valve train. Alternatively, the valve train may be provided with a camshaft having a diameter greater than that of a camshaft of the other valve train. However, if it is desirable to use camshafts having the same diameter for the pair of valve train, one of the camshafts, which drives the valve train including a rocker arm having a leverage greater than that of a rocker arm of the other valve trains, is supported by a bearing having a structural rigidity higher than that of a bearing for supporting the other camshaft.

DESCRIPTION OF THE PREFERRED EMBODIMENT

Because in general, overhead camshaft engines are well known, the present description will be directed in particular to elements forming part of, or cooperating directly with, the camshaft drive apparatus in accordance with the present invention. It is to be understood that elements not specifically shown or described can take various forms well known to those skilled in the automotive vehicle engine art.

Figure 1:
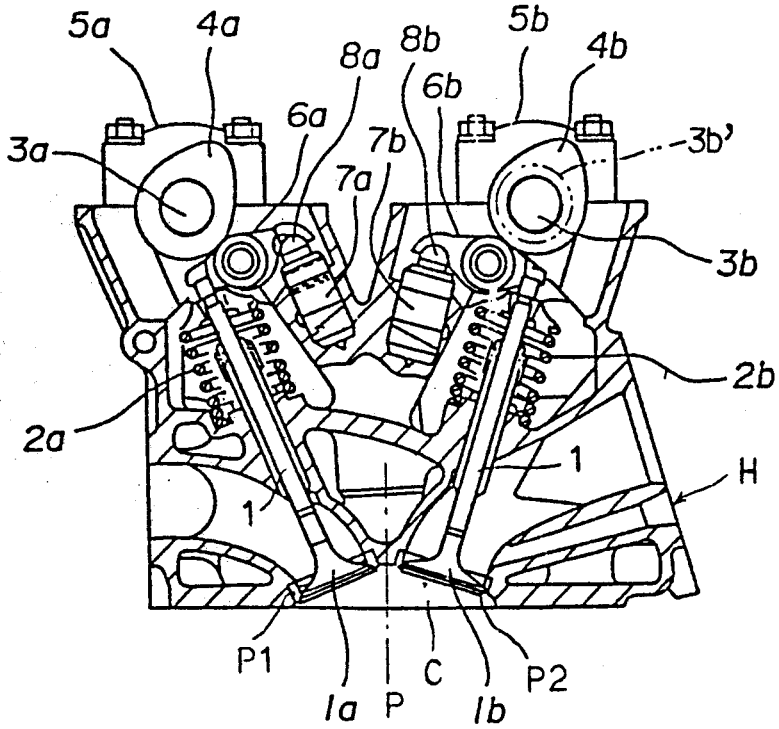
FIG. 1 is a cross-sectional view of a cylinder head provided with a valve drive apparatus in accordance with a preferred embodiment of the present invention.

Referring to the drawings in detail, in particular to FIG. 1, a valve drive apparatus of the type having swing arms or rocker arms for a double overhead camshaft engine is shown. A cylinder head H, integrally formed by aluminum casting, is mounted on a cylinder block (not shown) to form combustion chambers C in cylinders. The cylinder head H is formed with intake and exhaust ports P1 and P2 which open into the combustion chamber C and are arranged symmetrically with respect to the center axis P of the cylinder. The cylinder head H has intake and exhaust valves 1*a* and 1*b*, which have stems 1 slidably mounted and arranged in a V-formation. The stems 1 have a predetermined relative angle in the cylinder head H and move up and down so as to open or close the ports P1 and P2. The intake and exhaust valves 1*a* and 1*b*, which are usually force to close the intake and exhaust ports P1 and P2 respectively, by the aid of valve springs 2*a* and 2*b* loaded on the stems 1 of the intake and exhaust valves 1*a* and 1*b*, are driven by a valve drive apparatus to open and shut the intake and exhaust ports P1 and P2 at a desired timing. The valve drive apparatus includes two camshafts 3*a* and 3*b* in juxtaposition, each having one cam or camshaft lobe 4*a* or 4*b* thereon for each valve 1*a* or 1*b*. These camshafts 3*a* and 3*b* are mounted on the cylinder head H by camshaft bearing caps 5*a* and 5*b*, made by aluminum casting, respectively. Swing arms or rocker arms 6*a* and 6*b* are located so as to each have one end disposed to one side of its respective camshaft lobe 4*a* and 4*b* and in engagement with the top end of the valve stem 1 of the valves 1*a* and 1*b* to actuate the valves 1*a* and 1*b*, and the other end in contact with a pivoting end 8*a*, 8*b* of a hydraulic valve lash adjuster 7*a*, 7*b*. It is to be noted that although these hydraulic valve lash adjusters 7*a* and 7*b* per se are well known in structure and function and are the same in basic structure as each other, either one of the hydraulic valve lash adjusters 7*a* and 7*b*, for example the hydraulic valve lash adjuster 7*b* for the exhaust valve 1*b*, has a cross-sectional area larger than that of the other, 7*a*. This means that the hydraulic valve lash adjuster 7*b* for the exhaust valve 1*b* has a structural rigidity higher than the hydraulic valve adjuster 7*a* for the intake valve 1*a*.

The rocker arm 6*a*, 6*b* is operated by the camshaft lobe 4*a*, 4*b* slidably engaging, or rubbing directly on the rocker arm. The hydraulic valve lash adjuster 7*a*, 7*b* always maintains a zero valve stem-to-rocker arm clearance. As is well known in the art, the camshafts 3*a* and 3*b* are operationally connected to coupled to an engine crankshaft (not shown) by a timing belt or chain which transmits the engine output to drive the camshafts in synchronism in the same direction. To understand the operation of the valve train, reference is made to FIGS. 2 and 3, in conjunction FIG. 1.

Figure 2:
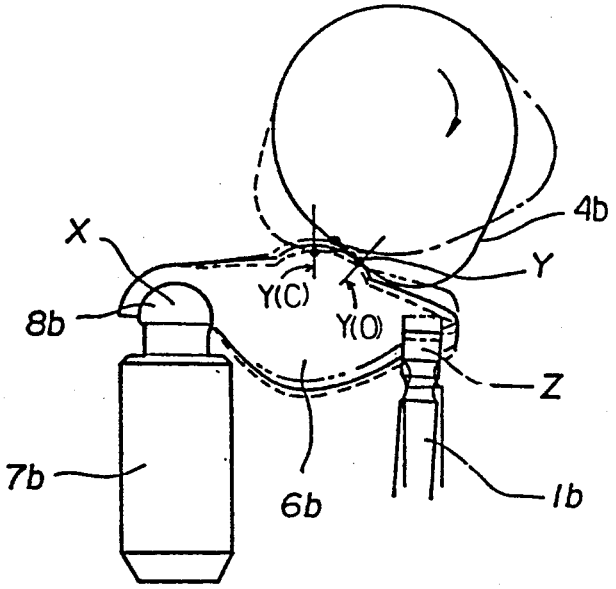
FIG. 2 is an illustration for explaining the change of leverage of a rocker arm.

As is shown in FIG. 2, the rocker arm 6*b* with a cam follower section 4*c* for the valve 1*b*, which acts as a lever, is pivoted by the pivot 8*b* of the hydraulic lash adjuster 7*b* at a pivot point X. The rocker arm 6*b* is in contact with the camshaft lobe 4*b* at a point of force application Y, and abuts against the top of the stem 1 of the valve 1*b* at a point of action Z. The camlobe 4*b* is designed to start the opening of valve at a point of force application Y(O) and the closing of valve at a point of force application Y(C). The point of force application Y shifts gradually towards the pivot point X, after shifting first slightly towards the point of action Z, on the cam follower section 4*c* as the camshaft lobe 4*b* turns in the counterclockwise direction. Subsequently, the point of force application Y shifts gradually back towards the point of action Z. The rocker arm 6*a* has a pivot point X, point of force application Y and point of action Z which are located symmetrically with respect to those of the rocker arm 6*b* relative to the center axis of the cylinder. Therefore, the point of force application Y of the rocker arm 6*a* gradually shifts towards the pivot point X and then back towards the point of action Z. After closing the valve 1*a*, the point of force application Y slightly shifts towards the pivot point X.

Thus, the camlobes 4*a* and 4*b* are considered to rotate in opposite directions with respect to, or as viewed from the relative positions of the point of force application Y of the rocker arms 6*a* and 6*b*. For this reason, leverages of the rocker arm 6*a* and 6*b*, which work as levers, change symmetrically as the camlobes 4*a* and 4*b* rotate in the same direction at the same speed. Considering XY to be a distance between the pivot point X and point of force application Y and XZ to be a distance between the pivot point X and point of action Y, the change of leverage XZ/XY for the rocker arm 6*a* as shown in FIG. 3A and that for the rocker arm 6*b* is shown in FIG. 3B.

Figure 3A:
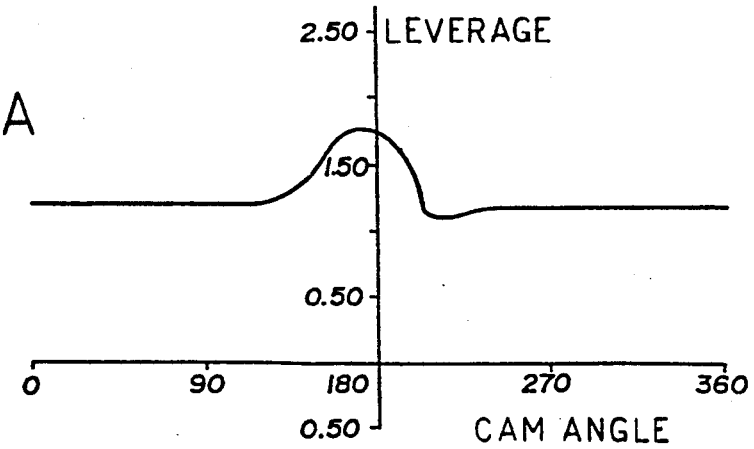
FIG. 3A and 3B are diagrams showing the changes of leverage of rocker arms.
Figure 3B:
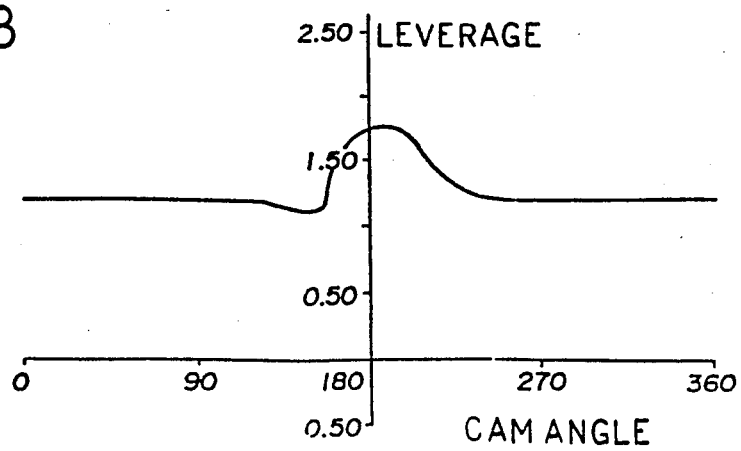

As is apparent from FIGS. 3A and 3B, the diagrams, showing the changes of leverage, are symmetrical to each other with respect to the angle of rotation of camlobe. The rocker arm 6*a* has a leverage XZ/XY smaller than that of the rocker arm 6*b* at a time immediately before closing the related valve. Accordingly, the valve train for the valve 1*a* has an equivalent rigidity larger than that of the valve train for the valve 1*b*. This means that the valve 1*a* is apt to produce unusual vibration at an engine speed lower than the engine speed at which the valve 1*b* produces unusual vibration. However, as was previously described, the hydraulic valve lash adjuster 7*a* of the valve train for the valve 1*a* is designed to provide the valve train with an equivalent rigidity substantially equal to that of the valve train for the valve 1*a*. Therefore, the critical engine speed is established according to that valve train having a rocker arm with a leverage, which decides an equivalent rigidity, which is smaller than the leverage of the rocker arm of the other.

To provide an increased equivalent rigidity of either one of the valve trains having a rocker arm with a leverage smaller than that of the rocker arm of the other valve train, it is also effective to use a camshaft 3*b* having a diameter larger than the diameter of the camshaft 3*a*, as is shown by dotted lines in FIG. 1.

Figure 4A:
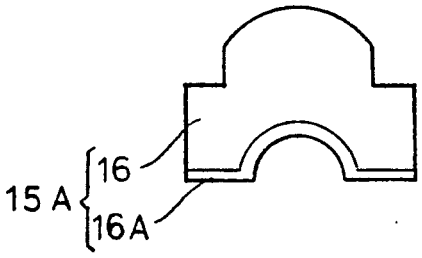
FIG. 4A to 4C are front views of various bearing caps.
Figure 4B:
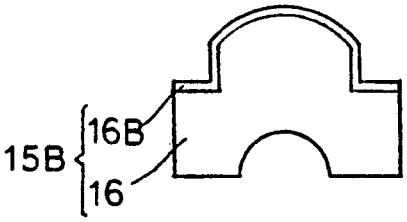
Figure 4C:
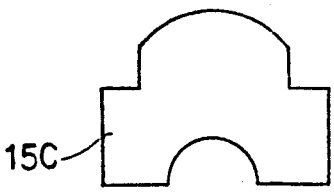

Otherwise, the bearing cap 5*b*, made by aluminum casting, may be replaced with a bearing cap 15A which comprises an aluminum cap block 16 and either an internal reinforcement metal lining 16A as is shown in FIG. 4A or an external reinforcement steel lining 16B as is shown in FIG. 4B. The bearing cap 5*b* may also be replaced with an integral bearing cap 15C made of a cast iron as is shown in FIG. 4C.

It is to be understood that although the invention has been fully described in detail with respect to a specific preferred embodiment, various other embodiments and variants are possible which fall in the spirit and scope of the invention, and such are intended to be covered by the following claims.

What is claimed is:

1. A valve drive apparatus for a double overhead camshaft engine having a pair of valves for each cylinder of said double overhead camshaft engine, said pair of valves having axes of movement arranged symmetrically at a predetermined relative angle with respect to a center axis of each cylinder, comprising:

a pair of overhead camshafts, each having a camlobe, arranged in juxtaposition over a cylinder head of said double overhead camshaft engine and rotating in the same direction; and a pair of valve trains, each having a rocker arm and a lash adjuster, disposed between said pair of overhead camshafts and said pair of valves so as to sequentially drive said pair of valves and arranged symmetrically with respect to said center axis;

said pair of valve trains being adapted so that one of said pair of valve trains which has a rocker arm leverage greater than a rocker arm leverage of the other of said pair of valve trains has a structural rigidity higher than a structural rigidity of said other of said pair of valve trains.

2. A valve drive apparatus as defined in claim 1, wherein the lash adjuster of said one of said pair of valve trains has a cross-sectional area greater than the lash adjuster of said other of said pair of valve trains.

3. A valve drive apparatus as defined as claim 1, wherein one of said pair of overhead camshafts for said one of said pair of valve trains has a diameter greater than the other of said pair of overhead camshafts for said other of said pair of valve trains.

4. A valve drive apparatus as defined in claim 1, wherein said cylinder is formed by aluminum casting.

5. A valve drive apparatus as defined in claim 4, and further comprising a pair of bearing caps for supporting said pair of overhead camshafts, one of said pair of bearing caps which supports one of said pair of overhead camshafts for said one of said pair of valve trains having a rigidity higher than another of said pair of bearing caps which supports the other of said pair of overhead camshafts for said other of said pair of valve trains.

6. A valve drive apparatus as defined in claim 5, wherein one of said pair of bearing caps comprises an aluminum cap block and an internal reinforcement metal lining.

7. A valve drive apparatus as defined in claim 5, wherein one of said pair of bearing caps comprises an aluminum cap block and an external reinforcement metal lining.

8. A valve drive apparatus as defined in claim 5, wherein one of said pair of bearing caps is made of cast iron.

9. A valve drive apparatus for a double overhead camshaft engine having a pair of valves for each cylinder of said double overhead camshaft engine, said pair of valves having axes of movement arranged symmetrically at a predetermined relative angle with respect o a center axis of each cylinder, comprising:

a pair of overhead camshafts, each having a camlobe, arranged in juxtaposition over a cylinder head of said double overhead camshaft engine and rotating in the same direction; and a pair of valve trains, each having a rocker arm and a lash adjuster, disposed between said pair of overhead camshafts and said pair of valves so as to sequentially drive said pair of valves and arranged symmetrically with respect to said center axis;

said pair of valve trains being adapted so that one of said pair of valve trains which has a rocker arm leverage, before closing a related valve, greater than rocker arm leverage of the other of said pair of valve trains, before closing a related valve, has a structural rigidity higher than a structural rigidity of said other of said pair of valve trains.

* * * * *